US011215423B1

(12) United States Patent
Spyropoulos

(10) Patent No.: US 11,215,423 B1
(45) Date of Patent: Jan. 4, 2022

(54) BIOMETRIC SAFETY HOLSTER APPARATUS

(71) Applicant: John Spyropoulos, East Bridgewater, MA (US)

(72) Inventor: John Spyropoulos, East Bridgewater, MA (US)

( * ) Notice: Subject to any disclaimer, the term of this patent is extended or adjusted under 35 U.S.C. 154(b) by 0 days.

(21) Appl. No.: 17/010,962

(22) Filed: Sep. 3, 2020

(51) Int. Cl.
*F41C 33/02* (2006.01)
*F41C 33/04* (2006.01)

(52) U.S. Cl.
CPC ..... *F41C 33/0263* (2013.01); *F41C 33/029* (2013.01); *F41C 33/0209* (2013.01); *F41C 33/041* (2013.01)

(58) Field of Classification Search
CPC .. F41C 33/029; F41C 33/0227; F41A 17/066; F41A 17/54
See application file for complete search history.

(56) References Cited

U.S. PATENT DOCUMENTS 5,828,301 A 10/1998 Sanchez
6,320,975 B1 * 11/2001 Vieweg ..... F41C 33/0227 382/124
6,533,149 B2 3/2003 Vor Keller
6,641,009 B2 * 11/2003 French ..... F41C 33/0209 224/193
6,876,756 B1 4/2005 Vieweg
D788,451 S 6/2017 Myers
2002/0158095 A1 * 10/2002 Vor Keller ..... F41A 17/04 224/244
2015/0369559 A1 * 12/2015 Del Rosario ..... H04N 5/77 340/686.4

FOREIGN PATENT DOCUMENTS

WO WO0065528 11/2000

* cited by examiner

*Primary Examiner* — Corey N Skurdal

(57) ABSTRACT

A biometric safety holster apparatus for preventing a firearm from being drawn by unwanted persons includes a holster body to receive a firearm while exposing a handle of the firearm above a body top side. A clip is coupled to the holster body to selectively engage a belt or a waistband. An actuator rod is coupled within a body inside to extend through a trigger guard of the firearm when a retractable portion is extended to prevent the firearm from being drawn from the holster body. A battery is coupled to the holster body and is in operational communication with the actuator rod. A biometric fingerprint reader is coupled to the holster body and is in operational communication with the actuator rod to retract the retractable portion and free the firearm.

10 Claims, 6 Drawing Sheets

BIOMETRIC SAFETY HOLSTER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to safety holster devices and more particularly pertains to a new safety holster device for preventing a firearm from being drawn by unwanted persons.

(2) Description of Related Art Including Information Disclosed Under 37 CFR 1.97 and 1.98

The prior art relates to safety holster devices. Existing devices have a variety of safety mechanisms to prevent unwanted drawing of firearms. These devices lack an actuator extending perpendicularly through the trigger guard. These devices also lack an internal thumbprint scanner working in conjunction with an external fingerprint scanner.

BRIEF SUMMARY OF THE INVENTION

An embodiment of the disclosure meets the needs presented above by generally comprising a holster body having a body inner side, a body outer side, a body front side, a body back side, a body bottom side, and an open body top side defining a body inside. The holster body is able to receive a firearm while exposing a handle of the firearm above the body top side. A clip is coupled to the holster body. The clip is coupled to the body inner side and is configured to selectively engage a belt or a waistband. An actuator rod is coupled to the holster body. The actuator rod is coupled to either the body inner side or the body outer side within the body inside. The actuator rod has a fixed portion and a retractable portion. The actuator rod is positioned and configured to extend through a trigger guard of the firearm when the retractable portion is extended to prevent the firearm from being drawn from the holster body. A battery is coupled to the holster body. The battery is in operational communication with the actuator rod. A biometric fingerprint reader is coupled to the holster body. The biometric fingerprint reader is coupled to the body outer side and is in operational communication with the actuator rod to retract the retractable portion and free the firearm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
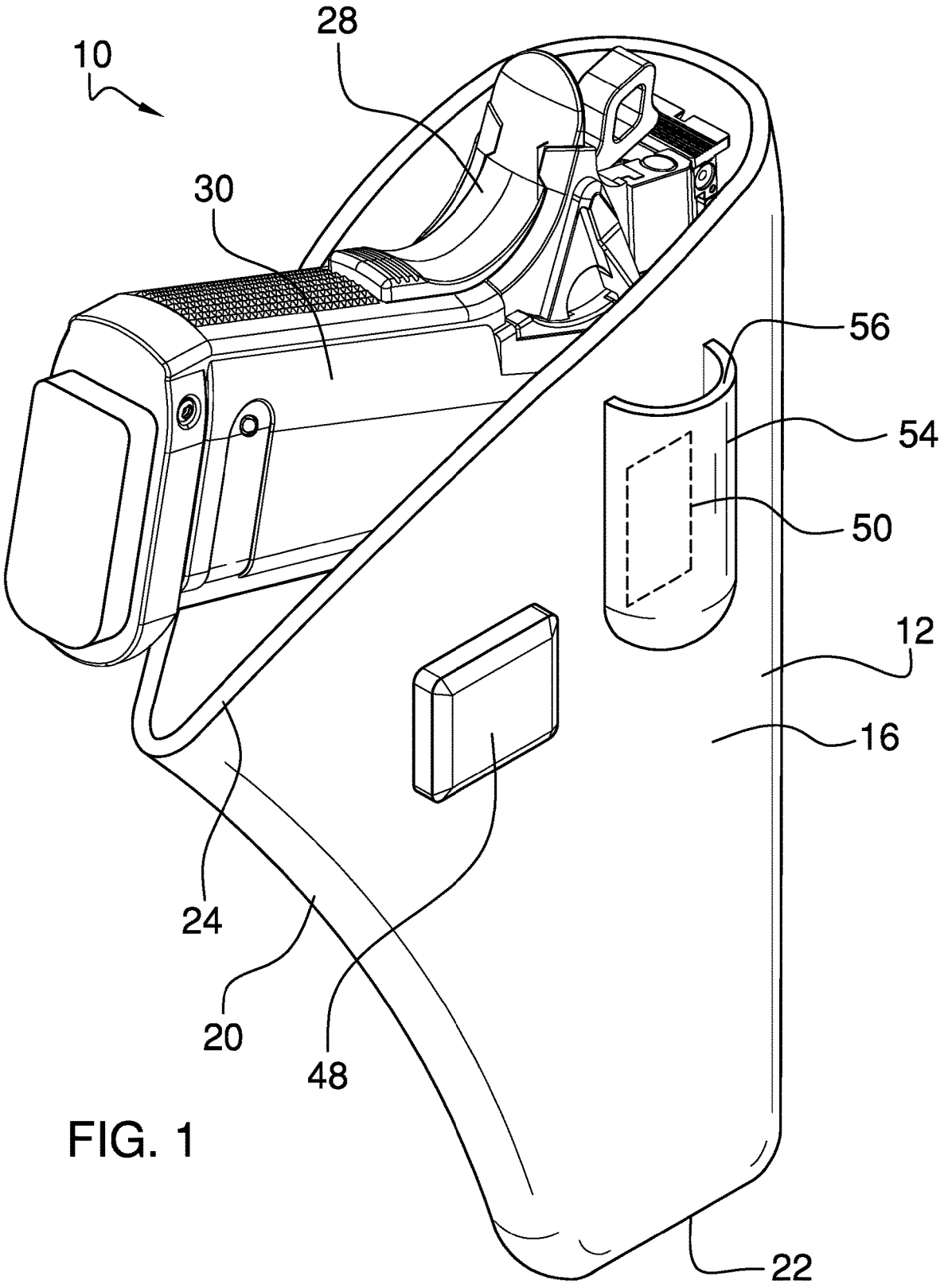
FIG. 1 is an isometric view of a biometric safety holster apparatus according to an embodiment of the disclosure.
Figure 2:
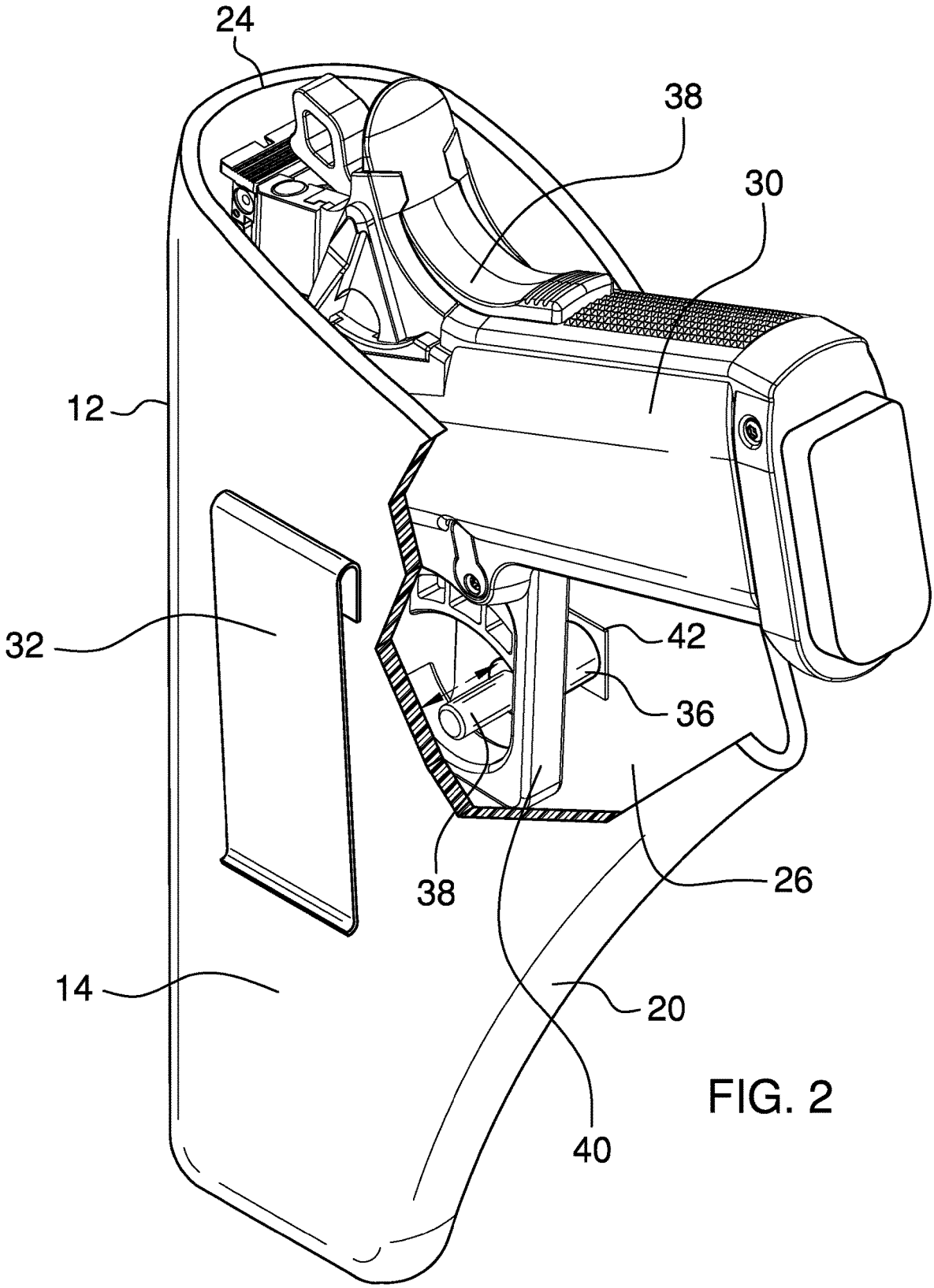
FIG. 2 is an isometric view of an embodiment of the disclosure.
Figure 3:
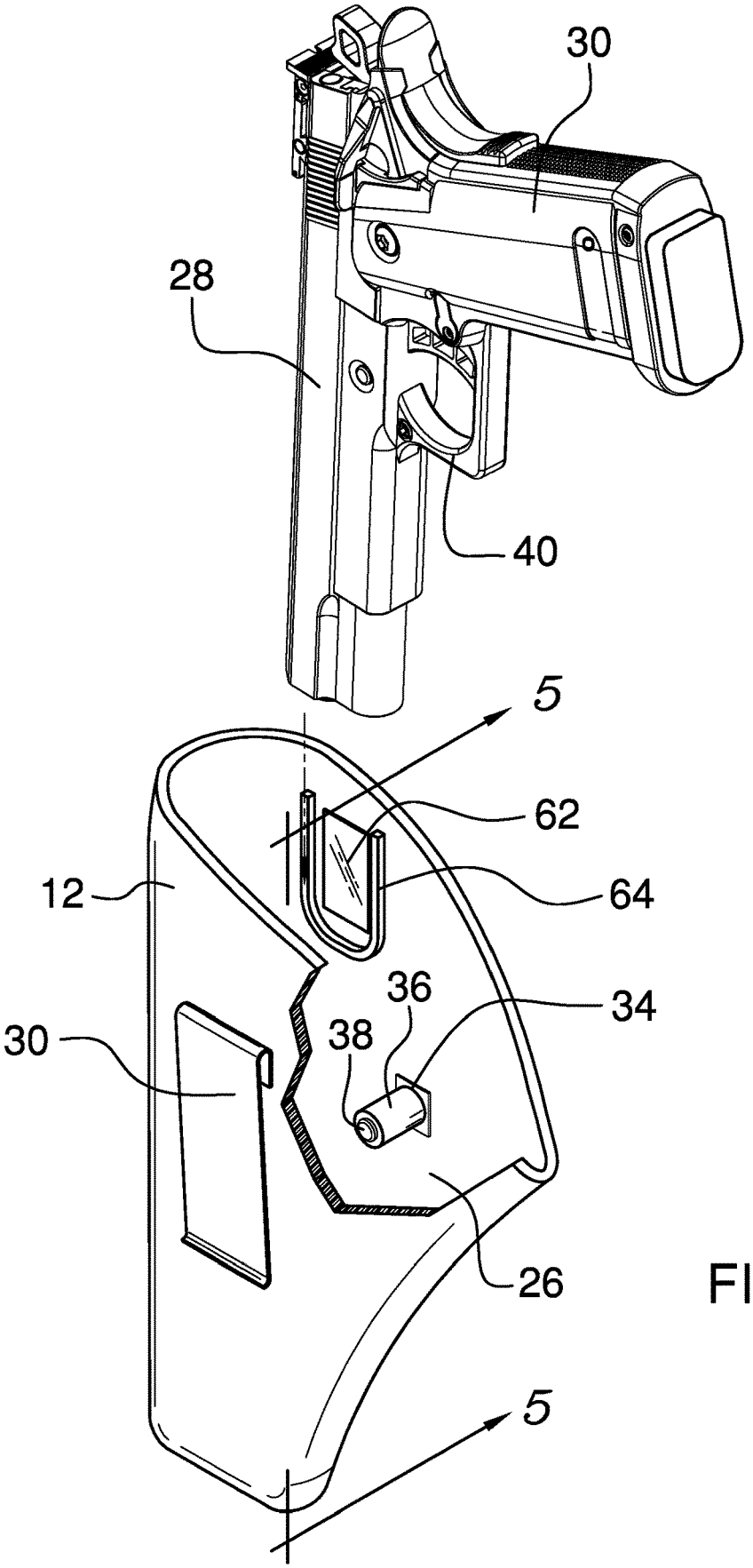
FIG. 3 is an isometric view of an embodiment of the disclosure.
Figure 4:
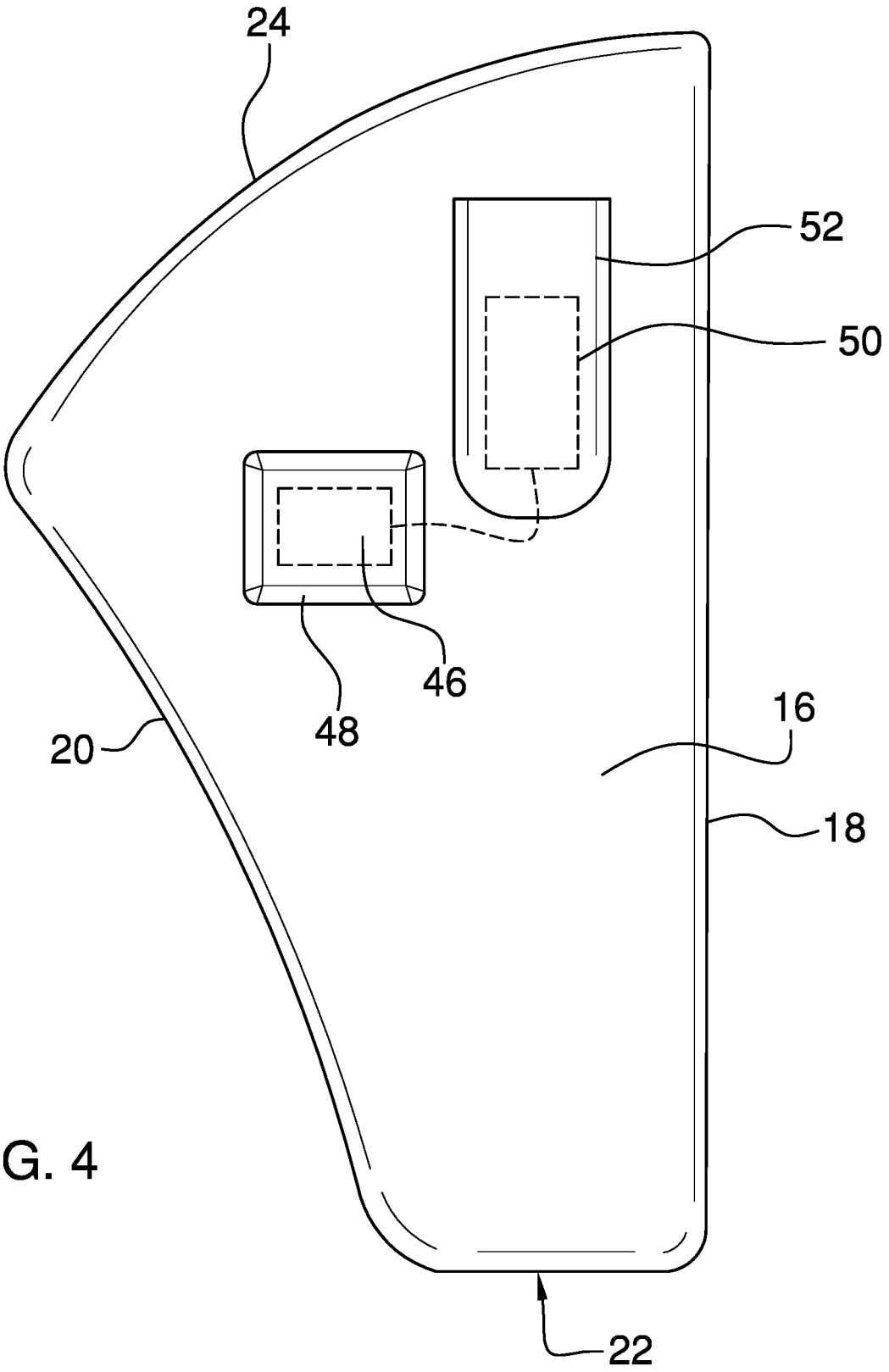
FIG. 4 is a front elevation view of an embodiment of the disclosure.
Figure 5:
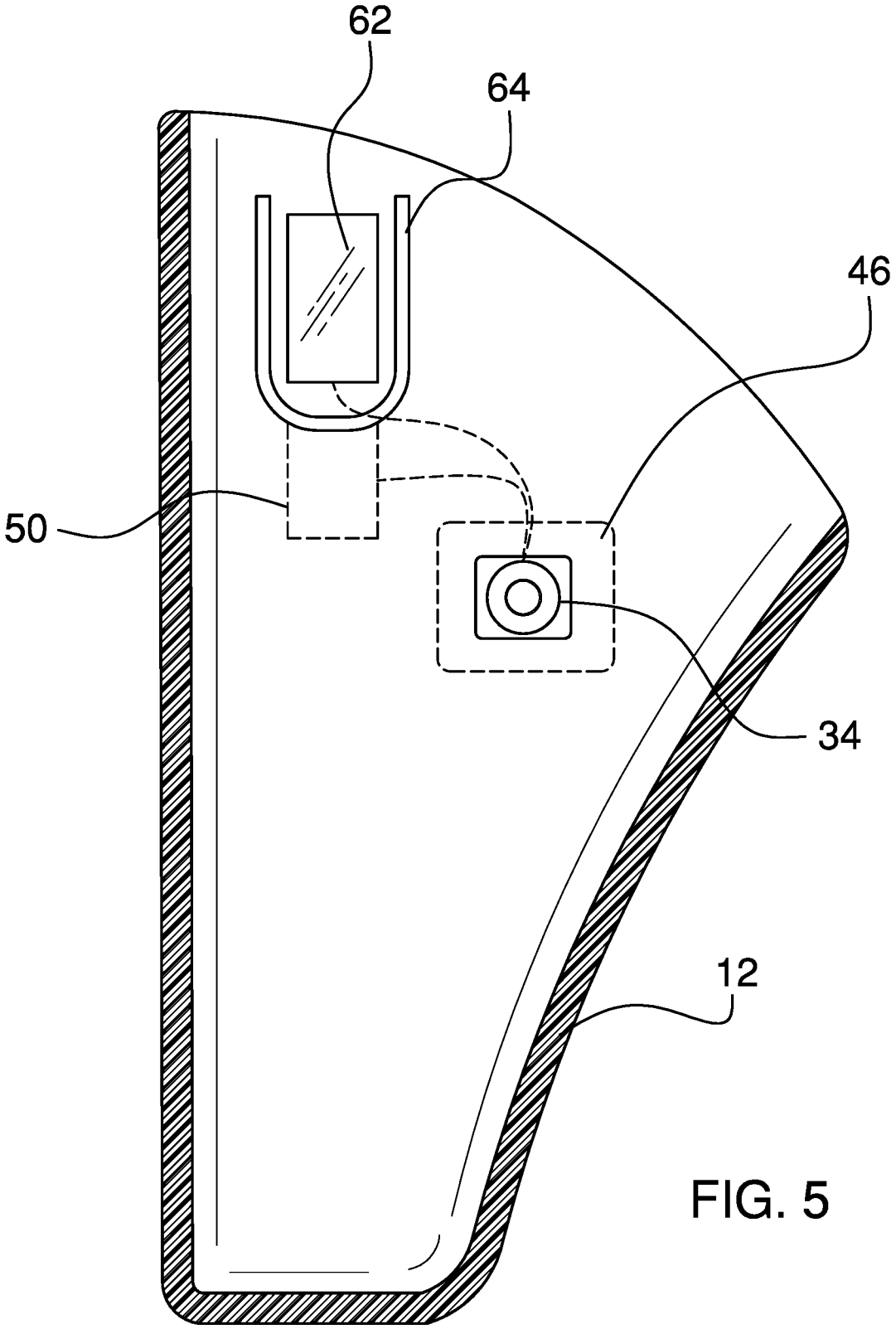
FIG. 5 is a cross-sectional view of an embodiment of the disclosure along the line 5-5 of FIG. 3.
Figure 6:
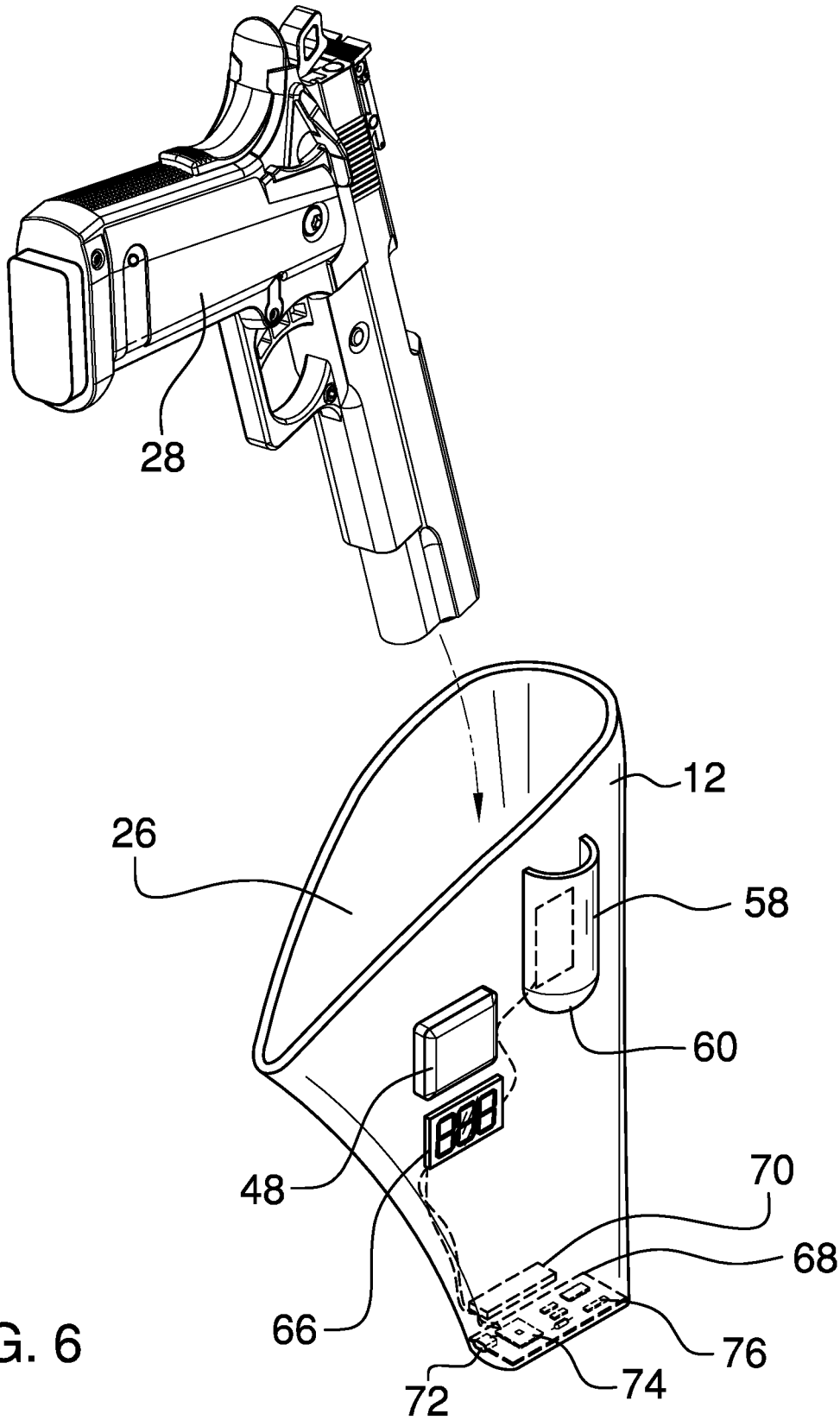
FIG. 6 is an isometric view of an embodiment of the disclosure.

With reference now to the drawings, and in particular to FIGS. 1 through 6 thereof, a new safety holster device embodying the principles and concepts of an embodiment of the disclosure and generally designated by the reference numeral 10 will be described.

As best illustrated in FIGS. 1 through 6, the biometric safety holster apparatus 10 generally comprises a holster body 12 having a body inner side 14, a body outer side 16, a body front side 18, a body back side 20, a body bottom side 22, and an open body top side 24 defining a body inside 26. The holster body 12 is able to receive a firearm 28 while exposing a handle 30 of the firearm above the body top side 24. The body front side 18 may be vertical and the body back side 20 and the body top side 24 may be arcuate. A clip 32 is coupled to the holster body 12. The clip 32 is coupled to the body inner side 14 and is configured to selectively engage a belt or a waistband.

An actuator rod 34 is coupled to the holster body 12. The actuator rod 34 is coupled to either the body inner side 14 or the body outer side 16 within the body inside 26. The actuator rod 34 has a fixed portion 36 and a retractable portion 38. The actuator rod 34 is positioned and configured to extend through a trigger guard 40 of the firearm when the retractable portion 38 is extended to prevent the firearm 28 from being drawn from the holster body 12. The fixed portion 36 may have a square base portion 42 and a cylindrical portion 44.

A battery 46 is coupled to the holster body 12 and is in operational communication with the actuator rod 34. The battery 46 may be coupled to the body outer side 16 and may have an external battery housing 48. The external battery housing 48 may be rectangular prismatic and has fileted edges.

A biometric fingerprint reader 50 is coupled to the holster body 12. The biometric fingerprint reader 50 is coupled to the body outer side 16 and is in operational communication with the actuator rod 34 to retract the retractable portion 38 and free the firearm 28. A finger sleeve 52 may be coupled to the holster body 12. The finger sleeve 52 has a sleeve body 54 covering the biometric fingerprint reader 50 and an open sleeve top side 56. The sleeve body 54 may have a semi-cylindrical sleeve sidewall portion 58 and a quarter-spherical sleeve bottom portion 60. The sleeve body 54 protects the biometric fingerprint reader 50 and guides the user's finger to allow use without looking.

A biometric thumbprint reader 62 may be coupled to the body outer side 16 within the body inside 26. The biometric thumbprint reader 62 is in operational communication with the biometric fingerprint reader 50. A guide ridge 64 may be coupled to the body outer side 16 adjacent the biometric thumbprint reader 62. The guide ridge 64 may be U-shaped and allows the user to find the biometric thumbprint reader 62 without looking.

A display 66 may be coupled to the holster body 12. The display 66 may be coupled to the body outer side 16. A counter system 68 is coupled to the holster body 12 within the body bottom side 22 and includes a secondary battery 70, a USB port 72, a microcontroller 74, and an NFC chip 76 each in operational communication with the display 66 and the actuator rod 34. The counter system 68 may be encased in an epoxy resin within the body bottom side 22 to prevent tampering. The display 66 shows the number of times the actuator rod 34 has been disengaged to draw the firearm 28 and may be an e-ink display to conserve power usage.

In use, the clip 32 is engaged with the user's belt or waistband and the firearm 28 is placed within the body inside 26. To draw the firearm the user must place his or her index finger on the biometric fingerprint reader 50 and/or thumb on the biometric thumbprint reader 62 to retract the retractable portion 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A biometric safety holster apparatus comprising:

a holster body having a body inner side, a body outer side, a body front side, a body back side, a body bottom side, and an open body top side defining a body inside, the holster body being able to receive a firearm while exposing a handle of the firearm above the body top side;

a clip coupled to the holster body, the dip being coupled to the body inner side and being configured to selectively engage a belt or a waistband;

an actuator rod coupled to the holster body, the actuator rod being coupled to either the body inner side or the body outer side within the body inside, the actuator rod having a fixed portion and a retractable portion, the actuator rod being positioned and configured to extend through a trigger guard of the firearm when the retractable portion is extended to prevent the firearm from being drawn from the holster body;

a battery coupled to the holster body, the battery being in operational communication with the actuator rod;

a biometric fingerprint reader coupled to the holster body, the biometric fingerprint reader being coupled to the body outer side and being in operational communication with the actuator rod to retract the retractable portion and free the firearm; and a biometric thumbprint reader coupled to the holster body, the biometric thumbprint reader being coupled to the body outer side within the body inside.

2. The biometric safety holster apparatus of claim 1 further comprising a finger sleeve coupled to the holster body, the finger sleeve having a sleeve body covering the biometric fingerprint reader and an open sleeve top side.

3. The biometric safety holster apparatus of claim 2 further comprising the sleeve body having a semi-cylindrical sleeve sidewall portion and a quarter-spherical sleeve bottom portion.

4. The biometric safety holster apparatus of claim 1 further comprising the body front side being vertical, the body back side and the body top side being arcuate.

5. The biometric safety holster apparatus of claim 1 further comprising the battery being coupled to the body outer side and having an external battery housing.

6. The biometric safety holster apparatus of claim 5 further comprising the external battery housing being rectangular prismatic and having fileted edges.

7. The biometric safety holster apparatus of claim 1 further comprising a guide ridge coupled to the holster body, the guide ridge being coupled to the body outer side adjacent the biometric thumbprint reader.

8. The biometric safety holster apparatus of claim 7 further comprising the guide ridge being U-shaped.

9. A biometric safety holster apparatus comprising:

a holster body having a body inner side, a body outer side, a body front side, a body back side, a body bottom side, and an open body top side defining a body inside, the holster body being able to receive a firearm while exposing a handle of the firearm above the body top side;

a clip coupled to the holster body, the clip being coupled to the body inner side and being configured to selectively engage a belt or a waistband;

an actuator rod coupled to the holster body, the actuator rod being coupled to either the body inner side or the body outer side within the body inside, the actuator rod having a fixed portion and a retractable portion the actuator rod being positioned and configured to extend through a trigger guard of the firearm when the retractable portion is extended to prevent the firearm from being drawn from the holster body;

a battery coupled to the holster body, the battery being in operational communication with the actuator rod;

a biometric fingerprint reader coupled to the holster body, the biometric fingerprint reader being coupled to the body outer side and being in operational communication with the actuator rod to retract the retractable portion and free the firearm; and a display coupled to the holster body, the display being coupled to the body outer side; a counter system coupled to the holster body, the counter system being coupled within the body bottom side and including a secondary battery, a USE port, a microcontroller, and an NFC chip each being in operational communication with the display.

10. A biometric safety holster apparatus comprising:

a holster body having a body inner side, a body outer side, a body front side, a body back side, a body bottom side, and an open body top side defining a body inside, the holster body being able to receive a firearm while exposing a handle of the firearm above the body top side, the body front side being vertical, the body back side and the body top side being arcuate;

a clip coupled to the holster body, the clip being coupled to the body inner side and being configured to selectively engage a belt or a waistband;

an actuator rod coupled to the holster body, the actuator rod being coupled to either the body inner side or the body outer side within the body inside, the actuator rod having a fixed portion and a retractable portion, the actuator rod being positioned and configured to extend through a trigger guard of the firearm when the retractable portion is extended to prevent the firearm from being drawn from the holster body;

a battery coupled to the holster body, the battery being in operational communication with the actuator rod, the battery being coupled to the body outer side and having an external battery housing, the external battery housing being rectangular prismatic and having fileted edges;

a biometric fingerprint reader coupled to the holster body, the biometric fingerprint reader being coupled to the body outer side and being in operational communication with the actuator rod to retract the retractable portion and free the firearm;

a finger sleeve coupled to the holster body, the finger sleeve having a sleeve body covering the biometric fingerprint reader and an open sleeve top side, the sleeve body having a semi-cylindrical sleeve sidewall portion and a quarter-spherical sleeve bottom portion;

a biometric thumbprint reader coupled to the holster body, the biometric thumbprint reader being coupled to the body outer side within the body inside;

a guide ridge coupled to the holster body, the guide ridge being coupled to the body outer side adjacent the biometric thumbprint reader, the guide ridge being U-shaped;

a display coupled to the holster body, the display being coupled to the body outer side; and a counter system coupled to the holster body, the counter system being coupled within the body bottom side and including a secondary battery, a USB port, a microcontroller, and an NFC chip each being in operational communication with the display.

* * * * *